US008485914B2

(12) United States Patent
Martinez

(10) Patent No.: US 8,485,914 B2
(45) Date of Patent: Jul. 16, 2013

(54) TRAINING TOOL FOR GOLF

(76) Inventor: Thomas W. Martinez, Cheshire, CT (US)

( * ) Notice: Subject to any disclaimer, the term of this patent is extended or adjusted under 35 U.S.C. 154(b) by 0 days.

(21) Appl. No.: 13/595,131

(22) Filed: Aug. 27, 2012

(65) Prior Publication Data

US 2013/0053160 A1 Feb. 28, 2013

Related U.S. Application Data

(60) Provisional application No. 61/528,186, filed on Aug. 27, 2011.

(51) Int. Cl.
*A63B 69/36* (2006.01)

(52) U.S. Cl.
USPC ..... 473/226; 473/206

(58) Field of Classification Search
USPC ..... 473/206, 226, 227, 238, 266, 276, 473/277, 298, 299
See application file for complete search history.

(56) References Cited

U.S. PATENT DOCUMENTS

| | | | | |
|---|---|---|---|---|
| 3,834,714 | A * | 9/1974 | Smolinski | 473/201 |
| 4,595,204 | A * | 6/1986 | Patterson | 473/227 |
| 6,196,930 | B1 * | 3/2001 | Aumock | 473/206 |
| 7,435,185 | B1 * | 10/2008 | Butler | 473/239 |
| 7,789,765 | B2 * | 9/2010 | Marini | 473/226 |
| 2004/0048679 | A1 * | 3/2004 | Bunting | 473/226 |

* cited by examiner

*Primary Examiner* — Nini Legesse
(74) *Attorney, Agent, or Firm* — Bachman & LaPointe, P.C.

(57) ABSTRACT

A golf training tool includes a boot having a first open end to be fitted over a grip of a golf club, and a rod projecting from a second end of the boot opposed to the first open end and which rod extends into the boot.

11 Claims, 2 Drawing Sheets

TRAINING TOOL FOR GOLF

CROSS-REFERENCE TO RELATED APPLICATION(S)

The instant patent application claims the benefit of U.S. Provisional Patent Application No. 61/528,186, filed Aug. 27, 2011, entitled CHIPPING TRAINING TOOL FOR GOLF.

BACKGROUND

The present disclosure is directed to a training tool for golf, in particular a chipping training tool.

A common problem golfers have is the turning over of their wrists when using a chipping stroke. A number of devices have been developed to deal with this problem. One of the devices is an oversized golf club, about 66 inches in length or longer. The device can not be easily stowed for transport in a golf bag. Further, not every person can use it because of its length and weight.

Other devices intended to help improve one's chipping stroke are shown in U.S. Pat. No. 6,196,930 to Aumock and U.S. Pat. No. 7,789,765 to Marini.

There remains a need for a lightweight device to help train golfers with regard to their chipping.

SUMMARY

In accordance with the present disclosure, there is provided a golf training tool which broadly comprises a boot having a first open end to be fitted over a grip of a golf club, and a rod projecting from a second end of the boot opposed to the first open end, which rod extends into the boot.

The golf training tool described herein can be used by any golfer, regardless of age or gender. Furthermore, it is small, light portable, convenient and simple to use by anyone of any age.

Other details of the golf training tool of the present invention, as well as other advantages attendant thereto, are set forth in the following detailed description and the accompanying drawings, wherein like reference numerals depict like elements.

DETAILED DESCRIPTION OF THE PREFERRED EMBODIMENT(S)

Figure 1:
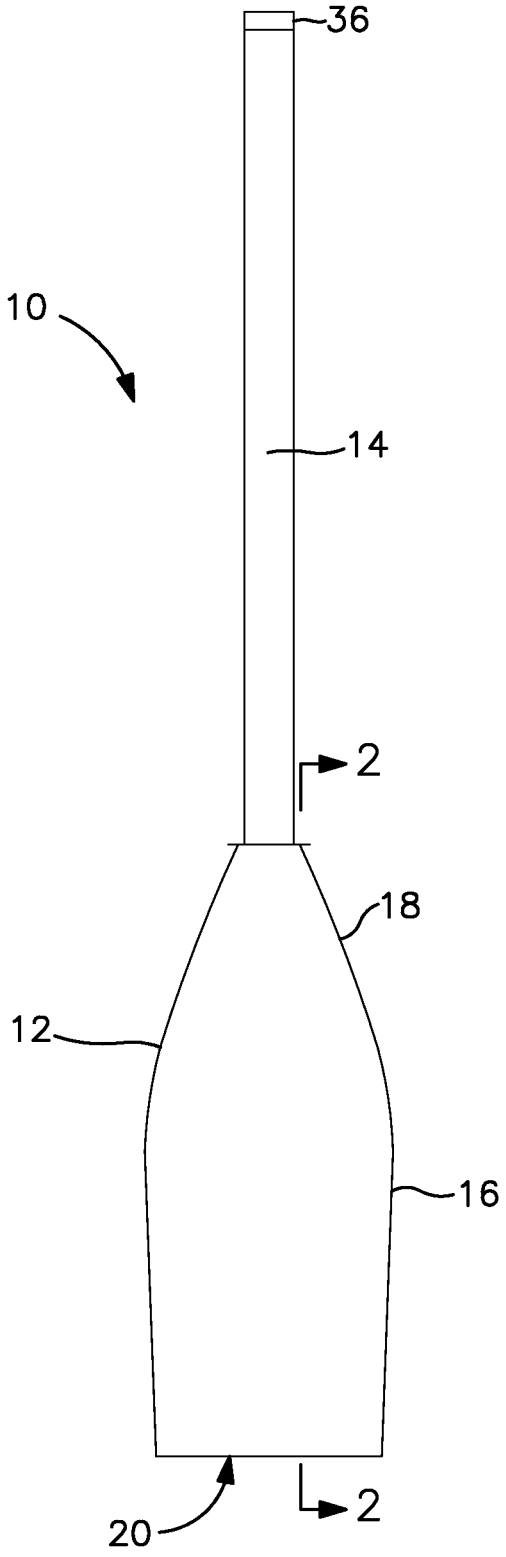
FIG. 1 is a perspective view of a golf training tool.

Referring now to FIG. 1, there is shown a golf training tool 10 in accordance with the present disclosure. The golf training tool 10 has a boot 12 and a rod 14 extending through and out the boot 12.

Figure 2:
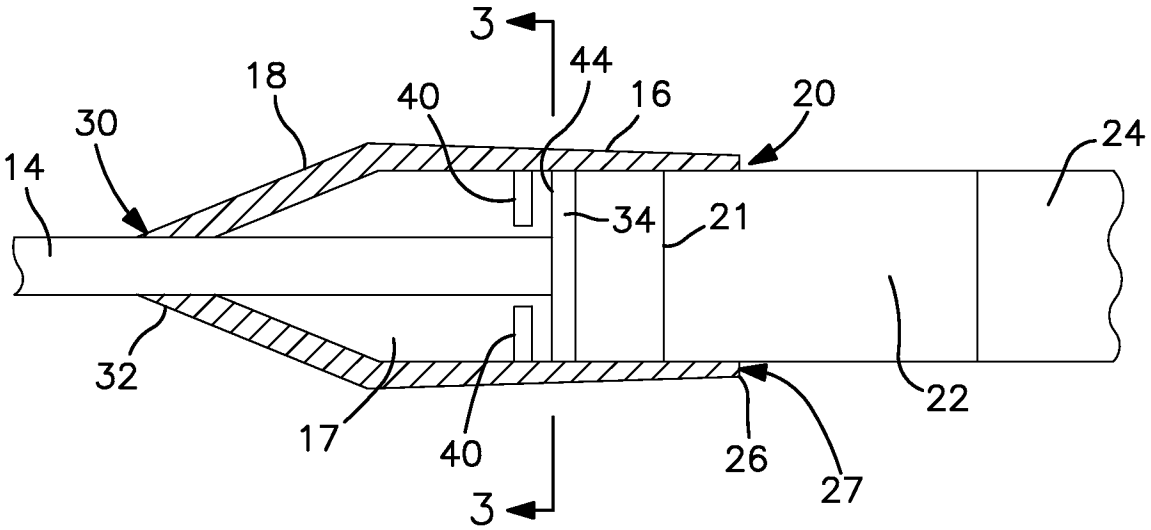
FIG. 2 is a sectional view of the golf training tool of FIG. 1 taken along lines 2-2 of FIG. 1.

Referring now to FIGS. 1 and 2, the boot 12 is formed from a flexible, lightweight material such as a rubber or plastic material. The boot 12 has a tapered lower portion 16 and a conically shaped upper portion 18. The interior 17 of the boot 12 is hollow.

The lower portion 16 of the boot 12 has an open end 20 for receiving an end 21 of a golf grip 22 attached to a golf club 24. The open end 20 allows the lower portion 16 to be placed over the golf grip end 21. The circumferential edge 26 of the boot

12 which defines the open end 20 is positioned so as to overlap and circumscribe the periphery of the golf grip 22. The opening 27 in the open end 20 is sized so as to allow for frictional engagement between the lower portion 16 of the boot 12 and the golf grip 22.

The upper portion 18 of the boot has a second opening 30 in a second end 32. As can be seen from FIG. 2, the rod 14 extends through the opening 30. This allows the rod 14 to be slidable/movable with respect to the boot 12.

The rod 14 may be hollow and may be formed from a flexible and bendable plastic material. A first end of the rod 14 has an integrally formed plate 34. The plate 34 may abut the end of the golf grip 22 when the boot 12 is placed onto the end of the golf club.

The second end of the rod 14 may be covered by a cap 36. The cap 36 may be formed from a plastic material.

Figure 3:
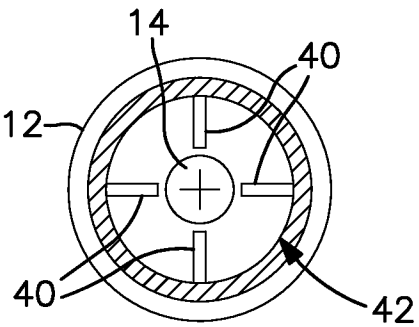
FIG. 3 is a sectional view of the boot taken along lines 3-3 of FIG. 2

Referring now to FIGS. 2 and 3, the boot 12 has a plurality of stops 40 radially extending inwardly from the interior wall 42. The stops 40 limit the upward movement of the rod 14 by contacting a surface 44 of the plate 34.

In use, the boot 12 is mounted on the golf club. The rod 14 extending from the top of the boot 12 indicates wrist turn (fault, excess, failure) by light (force) tapping on the side of a golfer. The boot 12 transfer energy (action) from the grip/shaft of the golf club up the rod 14 to indicate wrist fault resulting in the above side tapping if the golfer performs a nonpreferred motion. When the golfer performs the proper motion, there is no tapping of the rod on the golfer's side.

As can be seen from the foregoing description, there has been provided a chipping training tool which is small, light, portable, convenient and simple to use. Further, there has been provided a chipping training tool which can be used with a variety of golf clubs. Still further, there has been provided a chipping tool which can be easily installed on a golf club and does not require any locking mechanisms or strap devices that can come loose during use.

There has been provided in accordance with the instant disclosure a golf training tool. While the golf training tool has been described in the context of specific embodiments thereof, other unforeseen alternatives, modifications, and variations may become apparent to those skilled in the art having read the foregoing disclosure. Accordingly, it is intended to embrace those alternatives, modifications, and variations as fall within the broad scope of the appended claims.

What is claimed is:

1. A golf training tool comprising:

a boot having a first open end to be fitted over a grip of a golf club;

a rod projecting from a second end of said boot opposed to said first open end; and said rod extending into said boot, wherein said rod is movable with respect to said boot.

2. A golf training tool according to claim 1, wherein said rod has a plate attached to a first end of said rod.

3. A golf training tool according to claim 2, wherein said rod and said plate are integrally formed together.

4. A golf training tool according to claim 2, wherein said rod is hollow and formed from a flexible plastic material.

5. A golf training tool according to claim 2, further comprising a cap placed over a second end of said rod opposed to said first end.

6. A golf training tool according to claim 1, further comprising said boot being formed from a flexible material.

7. A golf training tool according to claim 1, further comprising said first open end of said boot having a circumferential edge which frictionally engages the golf club grip about an entire periphery thereof.

8. A golf training tool according to claim 1, wherein said boot has a hollow interior.

9. A golf training tool comprising:

a boot having a first open end to be fitted over a grip of a golf club;

a rod projecting from a second end of said boot opposed to said first open end;

said rod extending into said boot; and a plurality of stops formed within the hollow interior of said boot for engaging a plate attached to an end of said rod for limiting upward movement of said rod.

10. A golf training tool according to claim 9, wherein said rod is movable with respect to said boot.

11. A golf training tool according to claim 9, wherein each of said stops projects radially inwardly from an interior wall of said boot.

* * * * *